US009187284B2

(12) United States Patent
Sato

(10) Patent No.: US 9,187,284 B2
(45) Date of Patent: Nov. 17, 2015

(54) SHEET DISCHARGE DEVICE AND IMAGE FORMING APPARATUS

(71) Applicant: CANON KABUSHIKI KAISHA, Tokyo (JP)

(72) Inventor: Koki Sato, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/462,769

(22) Filed: Aug. 19, 2014

(65) Prior Publication Data

US 2015/0054215 A1 Feb. 26, 2015

(30) Foreign Application Priority Data

Aug. 22, 2013 (JP) ..... 2013-172141

(51) Int. Cl.
*B65H 29/52* (2006.01)
*B65H 31/26* (2006.01)
*B65H 43/06* (2006.01)

(52) U.S. Cl.
CPC ..... *B65H 29/52* (2013.01); *B65H 31/26* (2013.01); *B65H 43/06* (2013.01); *B65H 2301/5133* (2013.01); *B65H 2404/561* (2013.01); *B65H 2404/63* (2013.01); *B65H 2511/152* (2013.01); *B65H 2511/214* (2013.01); *B65H 2801/06* (2013.01)

(58) Field of Classification Search
CPC ..... B65H 5/004; B65H 29/52; B65H 29/70; B65H 29/14; B65H 2404/50; B65H 2404/533; B65H 2404/61; B65H 2404/691; B65H 2515/716; B65H 2301/5133; B65H 43/06; B65H 31/26; B65H 2404/63; B65H 2801/06; B65H 2511/214; B65H 2511/152
USPC ..... 271/208, 176
See application file for complete search history.

(56) References Cited

U.S. PATENT DOCUMENTS

| | | | | |
|---|---|---|---|---|
| 4,951,935 | A * | 8/1990 | Oikawa | 271/208 |
| 4,994,861 | A * | 2/1991 | Brandon et al. | 399/315 |
| 5,713,060 | A | 1/1998 | Sato et al. | |
| 6,487,379 | B2 | 11/2002 | Sato | |
| 7,883,079 | B2 | 2/2011 | Sato et al. | |
| 2009/0189344 | A1 * | 7/2009 | Suzuki | 271/314 |

FOREIGN PATENT DOCUMENTS

| | | | |
|---|---|---|---|
| JP | 11-171388 | A | 6/1999 |
| JP | 2003-238016 | A | 8/2003 |

* cited by examiner

*Primary Examiner* — David H Bollinger
(74) *Attorney, Agent, or Firm* — Fitzpatrick, Cella, Harper & Scinto

(57) ABSTRACT

A sheet discharge device includes a sheet discharge portion configured to discharge a sheet, a destaticizing brush coming into contact with the sheet discharged by the sheet discharge portion and destaticizing the sheet, and a guide member turning by being pushed by the sheet discharged by the sheet discharge portion and guiding the sheet to a stacking portion on which the discharged sheet is to be stacked. The guide member includes a guide portion guiding the discharged sheet to the stacking portion and a recede portion provided at a position facing the destaticizing brush and accepting the destaticizing brush deformed by being pushed by the sheet.

14 Claims, 7 Drawing Sheets

SHEET DISCHARGE DEVICE AND IMAGE FORMING APPARATUS

BACKGROUND OF THE INVENTION

1. Field of the Invention

The present invention relates to a sheet discharge device and an image forming apparatus including the same.

2. Description of the Related Art

Hitherto, an image forming apparatus such as a copier, a printer, a facsimile, and a multi-function printer includes a sheet discharge device configured to discharge a sheet on which an image has been formed to a discharged sheet stacking portion provided outside of the image forming apparatus.

There is known such a sheet discharge device provided with a destaticizing brush at a sheet discharge port as disclosed in Japanese Patent Application Laid-open No. Hei. 11-171388 for example. The destaticizing brush makes it possible to stack the sheet stably on the discharged sheet stacking portion by removing static electricity accumulated in the sheet during conveyance thereof before discharging the sheet to the discharged sheet stacking portion. There is also known a sheet discharge device provided with a full-load detection lever configured to detect a full-load of sheets stacked on the discharged sheet stacking portion as disclosed in Japanese Patent Application Laid-open No. 2003-238016. The full-load detection lever also functions as a guide member guiding a sheet being discharged to the discharged sheet stacking portion.

Here, if the sheet discharge device includes the destaticizing brush and the full-load detection lever for example, it is conceivable that the destaticizing brush may be damaged by being sandwiched by the full-load detection lever and the sheet in discharging the sheet. That is, if the discharge of the sheet is continued in the state in which the destaticizing brush is sandwiched by the sheet to be discharged and the full-load detection lever, there is a possibility that tips of the destaticizing brush may be curled and deformed. If the tips of the destaticizing brush are cured, there is a possibility that parts where the destaticizing brush cannot be in contact with the sheet are brought about and it becomes unable to assure stable destaticizing performance. Still further, if the tips of the destaticizing brush are curled and if the tips of the destaticizing brush are tilted by being pushed by a front end of the sheet, and if an edge of a curled tip comes in contact with a full-load detection lever prior to a sheet, a reaction force caused by own weight of the full-load detection lever acts on the destaticizing brush. If the reaction force from the full-load detection lever acts on the destaticizing brush, there is a possibility that marks made by contact with the destaticizing brush are generated at the front end of the sheet, thus dropping quality of the sheet.

SUMMARY OF THE INVENTION

According to an aspect of the invention, a sheet discharge device includes a sheet discharge portion configured to discharge a sheet, a destaticizing brush coming into contact with the sheet discharged by the sheet discharge portion and destaticizing the sheet, and a guide member turning by being pushed by the sheet discharged by the sheet discharge portion and guiding the sheet to a stacking portion on which the discharged sheet is to be stacked. The guide member includes a guide portion guiding the discharged sheet to the stacking portion and a recede portion provided at a position facing the destaticizing brush and accepting the destaticizing brush deformed by being pushed by the sheet.

Further features of the present invention will become apparent from the following description of exemplary embodiments (with reference to the attached drawings).

DESCRIPTION OF THE EMBODIMENTS

An image forming apparatus according to an embodiment of the present invention will be explained below with reference to the drawings. The image forming apparatus of the embodiment of the present invention is a copier, a printer, a facsimile, or a multi-function printer including a sheet discharge device, configured to discharge a sheet on which an image has been formed to outside of the apparatus. The image forming apparatus will be explained by exemplifying an electro-photographic laser beam printer (referred to simply as a 'printer' hereinafter) 100 in the following embodiment.

Figure 1:
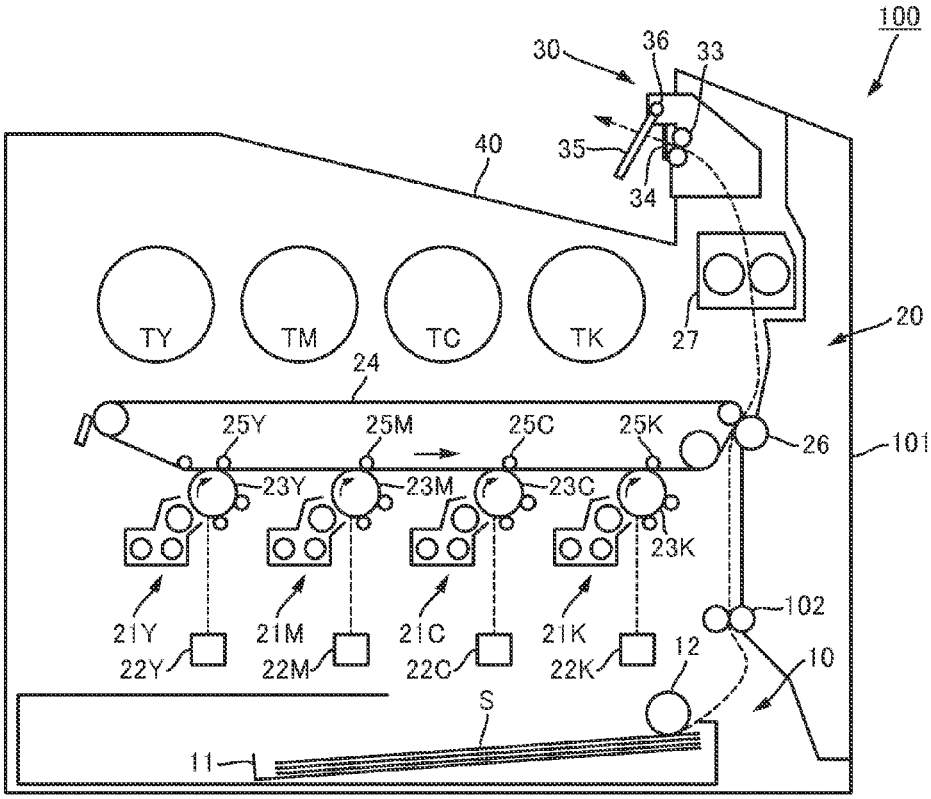
FIG. 1 is a section view schematically showing a printer of an embodiment of the present invention.
Figure 2:
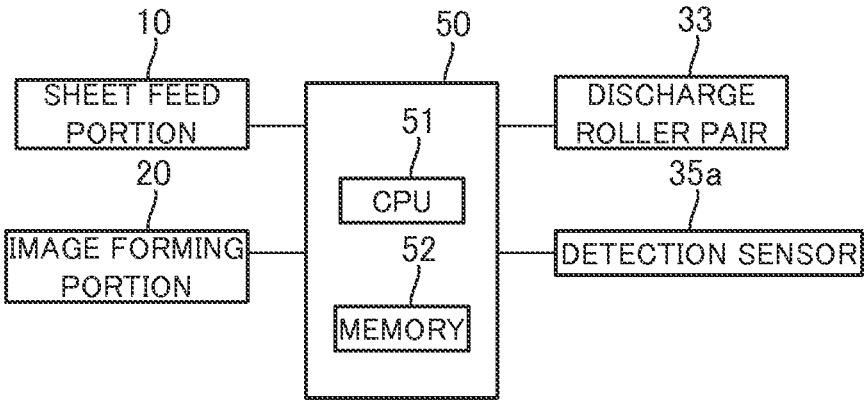
FIG. 2 is a block diagram showing a configuration of a control portion of the printer of the present embodiment.

At first, a schematic structure of the printer 100 of the embodiment of the present invention will be explained with reference to FIGS. 1 and 2. FIG. 1 is a section view schematically showing the printer 100 of the embodiment of the present invention. FIG. 2 is a block diagram showing a configuration a control portion of the printer 100 of the present embodiment.

As shown in FIG. 1, the printer 100 includes a sheet feed portion 10 configured to feed a sheet S, an image forming portion 20 configured to form an image on the sheet S, and a sheet discharge device 30 configured to discharge the sheet S on which the image has been formed to outside of the apparatus. The printer 100 also includes a discharged sheet stacking portion (stacking portion) 40 on which the discharged sheet S is stacked, and a control portion 50 configured to control those devices described above.

The sheet feed portion 10 includes a fed sheet stacking portion 11 on which the sheet S is stacked, and a feed roller 12 configured to feed the sheet S stacked on the fed sheet stacking portion 11 one by one.

The image forming portion 20 includes four process cartridges 21Y through 21K, respectively forming images of yellow (Y), magenta (M), cyan (C), and black (K), and exposure devices 22Y through 22K exposing surfaces of photoconductive drums 23Y through 23K described later. It is noted that because the four process cartridges 21Y through 21K are constructed in the same manner with each other except that the colors of the images to be formed are different, only the construction of the process cartridge 21Y forming the yellow (Y) image will be explained and an explanation of the process cartridges 21M through 21K will be omitted here. It is noted that reference numerals TY through TK in FIG. 1 denote toner cartridges in which each color toner is sealed.

The process cartridge 21Y includes a photoconductive drum 23Y, a charging roller configured to charge the photoconductive drum 23Y, and a developing roller configured to develop an electrostatic latent image formed on the photoconductive drum 23Y. The image forming portion 20 further includes an intermediate transfer belt on which toner images on the photoconductive drums 23Y through 23K are primarily transferred, and primary transfer rollers 25Y through 25K primarily transferring the toner images on the intermediate transfer belt 24. The image forming portion 20 also includes a secondary transfer portion 26 configured to secondarily transfer the toner images primarily transferred to the intermediate transfer belt 24 to a sheet S and a fixing portion 27 heating and fixing the toner images secondarily transferred to the sheet S.

The sheet discharge device 30 is provided downstream in a sheet conveying direction of the fixing portion 27 and is configured to be able to discharge the sheet S on which the image has been fixed to outside of the apparatus. It is noted that a concrete structure of the sheet discharge device 30 will be described later in detail. The discharged sheet stacking portion 40 is provided at an upper part of a casing 101 of the printer 100 and is formed to be able to stack the sheet S discharged out of the sheet discharge device 30.

As shown in FIG. 2, the control portion 50 includes a CPU 51 driving and controlling the sheet feed portion 10 and the image forming portion 20, and a memory storing various programs and information such as an image forming program executing the image forming operation. By receiving a signal from a detection sensor 35*a* described later during the image forming operation for example, the CPU 51 stops the image forming operation by driving and controlling the sheet feed portion 10 and the image forming portion 20.

Next, the image forming operation (image forming control made by the control portion 50) of the printer 100 will be explained. When image information is inputted from an external PC or the like, the exposure devises 22Y through 22K irradiate laser beams to the photoconductive drums 23Y through 23K based on the inputted image information. At this time, the photoconductive drums 23Y through 23K are charged in advance by the charging roller, and the electrostatic latent images are formed on the photoconductive drums 23Y through 23K by the laser beams irradiated thereon. After that, the electrostatic latent images are developed by the developing roller, and the yellow (Y), magenta (M), cyan (c), and black (K) toner images are formed on the photoconductive drums 23Y through 23K. The toner images of the respective colors toner images formed on the photoconductive drums 23Y through 23K are superimposed on and transferred to the intermediate transfer belt 24 by the primary transfer rollers 25Y through 25K and are conveyed to the secondary transfer portion 26 by the intermediate transfer belt 24.

In parallel with the image forming operation described above, the sheet S stacked on the fed sheet stacking portion 11 is fed one by one by the feed roller 12 to a registration roller pair 102. The registration roller pair 102 corrects a skew of the sheet S and conveys the sheet S to the secondary transfer portion 26 at a predetermined conveyance timing to transfer the toner images on the intermediate transfer belt 24 to the sheet S. The sheet S on which the toner images have been transferred is then conveyed to the fixing portion 27 to fix the toner images. The sheet S is discharged by the sheet discharge device 30 to the discharged sheet stacking portion 40 and is sequentially stacked thereon. A specific discharging operation performed when the sheet S is discharged by the sheet discharge device 30 will be described later in detail.

Figure 3:
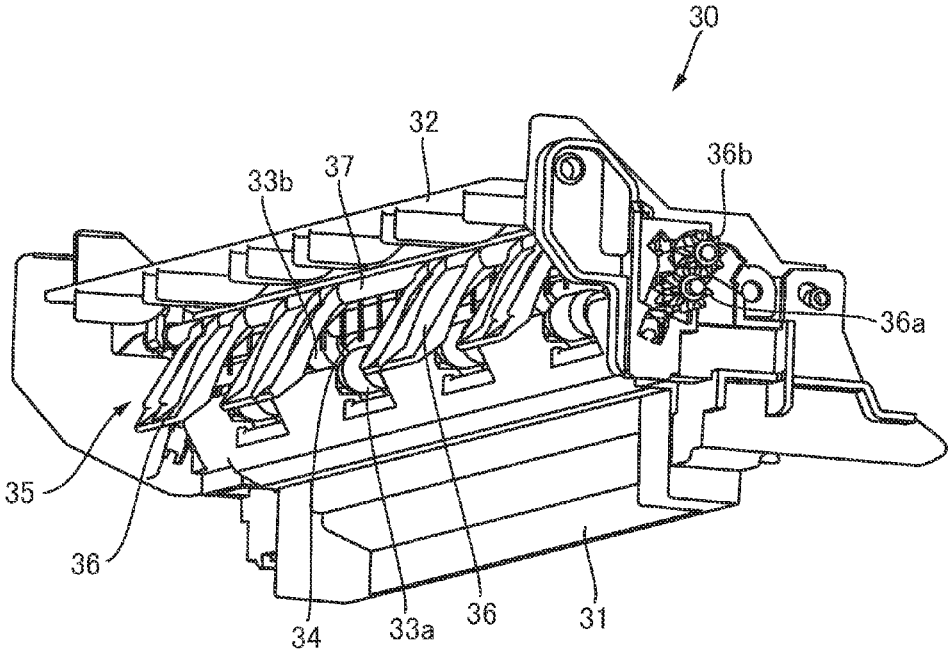
FIG. 3 is a perspective view showing a sheet discharge device of the present embodiment.
Figure 4:
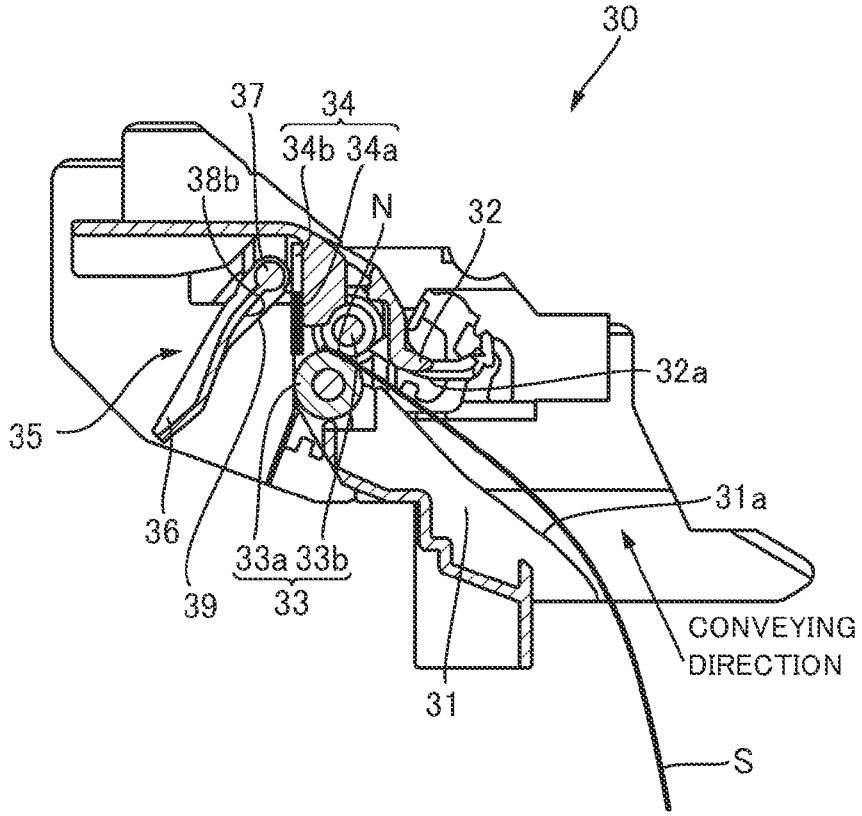
FIG. 4 is a section view of the sheet discharge device shown in FIG. 3.
Figure 5:
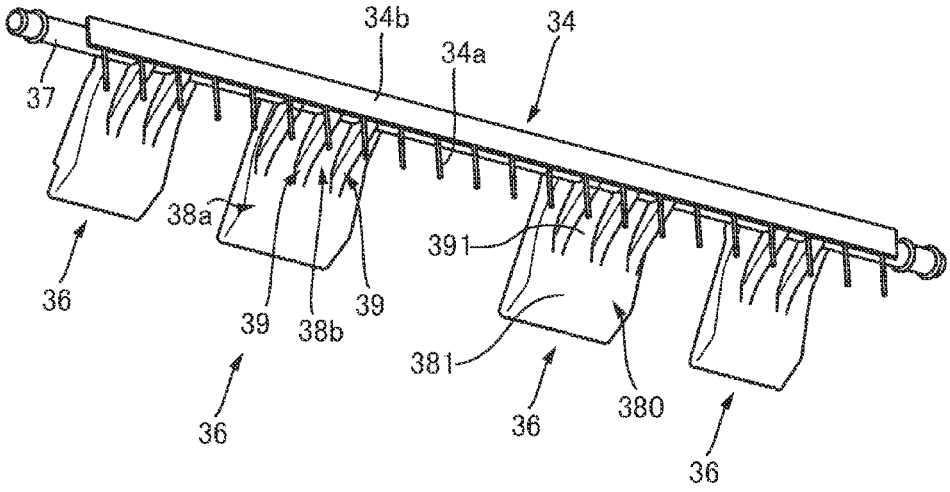
FIG. 5 is a perspective view showing a destaticizing brush and a detection lever.
Figure 6:
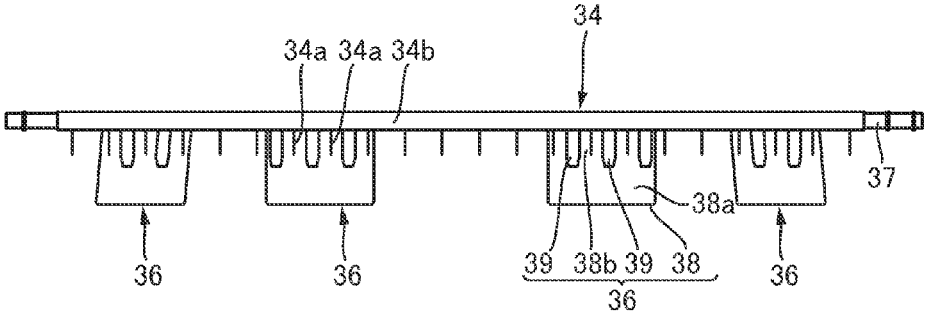
FIG. 6 is a plan view showing the destaticizing brush and the detection lever seen from above.

Next, the sheet discharge device 30 described above will be specifically explained with reference to FIGS. 3 through 7. At first, a configuration of the sheet discharge device 30 will be explained with reference to FIGS. 3 through 6. FIG. 3 is a perspective view showing the sheet discharge device 30 of the present embodiment. FIG. 4 is a section view of the sheet discharge device 30 shown in FIG. 3. FIG. 5 is a perspective view showing a destaticizing brush 34 and a detection lever 36. FIG. 6 is a plan view showing the destaticizing brush 34 and the detection lever 36 seen from above them.

As shown in FIGS. 3 and 4, the sheet discharge device 30 includes discharge lower and upper guides 31 and guiding the sheet S on which the image has been fixed, and a discharge roller pair (sheet discharge portion) 33 forming a sheet discharge nip discharging the sheet S to outside of the apparatus, and a destaticizing brush 34 coming into contact with the sheet S being discharged by the discharge roller pair to remove electricity of the sheet S. The sheet discharge device 30 further includes a full-load detection portion 35 configured to detect a full-load of the sheets S stacked on the discharged sheet stacking portion 40.

The discharge lower and upper guides 31 and 32 are provided downstream in the sheet conveying direction of the fixing portion 27 and guide the sheet S on which the image has been fixed in the fixing portion 27 to the nip N of the discharge roller pair 33 by lower and upper guide surfaces 31*a* and 32*a* thereof. It is noted that the discharge lower and upper guides 31 and 32 compose the casing (apparatus body) in a case where the sheet discharge device is the sheet discharge device.

The discharge roller pair 33 includes a discharge lower roller 33*a* rotatably supported by the discharge lower guide 31 and a discharge upper roller 33*b* rotatably supported by the discharge upper guide 32, and discharges the sheet S guided by the discharge lower and upper guides and 32 to outside of the apparatus. Specifically, the discharge lower and upper rollers 33*a* and 33*b* are connected to a driving source not shown through gears 36*a* and 36*b*, and are configured to rotate by being driven by the driving source. It is noted that although the discharge lower and upper rollers 33*a* and 33*b* are configured to rotate by being driven by the driving source in the present embodiment, it is possible to adopt a configuration in which one roller is driven by the other roller driven by the driving source.

The destaticizing brush 34 is provided downstream in the sheet discharge direction of the discharge roller pair 33 and removes electricity of the sheet S discharged by the discharge roller pair 33. The destaticizing brush 34 includes a plurality of hair-bundles (brush portion) 34*a* disposed substantially in parallel with a width direction orthogonal to the sheet discharge direction and coming into contact with the sheet S, and a support portion (base portion) 34*b* supporting the plurality of hair-bundles 34*a*. Each of the plurality of hair-bundles 34*a* is conductive and is formed of elastic stainless steel which is elastically deformable by coming into contact with the sheet S. Each of the plurality of hair-bundles 34*a* extends downward beyond the nip N of the discharge roller pair 33 and removes electric charge of the sheet S by coming into contact with the sheet S discharged out of the discharge roller pair 33. It is noted that the hair-bundle here means what is composed of two or more hairs, it may be composed of one hair. The support portion 34*b* is formed of a conductive material and is supported by the discharge upper guide 32 in a vicinity of the discharge roller pair 33. The support portion 34*b* is formed such that a length thereof is longer than a widthwise length of the sheet S that can be discharged by the sheet discharge device 30. The support portion 34*b* supports the plurality of hair-bundles 34*a* substantially at equal intervals substantially across an entire range in the width direction.

The full-load detection portion 35 includes a plurality of detection levers (guide member) 36 turnable centering on a rotational shaft 37 disposed downstream in the sheet discharge direction of the discharge roller pair and above the discharge roller pair 33, and detection sensor 35*a* (see FIG. 2) that sends a predetermined detection signal when the detection lever 36 reaches to a predetermined turning position. The detection levers 36 are turning members disposed at predetermined intervals in the width direction. In the present embodiment, the plurality of detection levers 36 composes a turning portion provided downstream in the sheet discharge direction of the destaticizing brush (the destaticizing portion) and configured to be turnable by coming into contact with an upper surface of a sheet bundle discharged on the discharged sheet stacking portion 40 to detect a sheet stacking amount of the stacking portion 40 by a turning amount thereof. Thus, it is possible to detect a sheet stacking amount on the stacking portion by a turning amount of the detection lever 36. That is, the plurality of detection levers 36 is a guide member that turns by being pushed by the sheet discharged by the discharge roller pair and guides the sheet to the discharged sheet stacking portion 40 on which the discharged sheet is to be stacked. Still further, the detection sensor 35*a* can be said as a sensor sending a signal corresponding to the turning position of the detection lever 36 when the detection lever 36 is in contact with the sheet stacked on the discharged sheet stacking portion 40. It is noted that the full-load detection portion 35 including the four detection levers 36 will be exemplified in the present embodiment, it is also possible to configure such that two detection levers are provided at both widthwise ends (two) or one detection lever is provided at a center.

As shown in FIG. 5, each of the plurality of detection levers 36 detects the sheet stacking amount stacked on the discharged sheet stacking portion 40 by its turning amount, and turns clockwise by being pushed by the sheet S during the sheet discharging operation, the detection levers 36 function as a conveyance guide on an upper surface side of the sheet S. Each of the plurality of detection levers 36 turns counterclockwise (turns to a standby position by its own weight) when the sheet discharge operation ends. That is, each of the detection levers 36 has a function of biasing and pressing the sheet S to the discharged sheet stacking portion 40.

Each of the detection lever 36 includes an abutment portion 38*a* provided at a front end side of the lever and is abuttable against the upper surface of the sheet S stacked on the discharged sheet stacking portion 40, and a plurality of guide portions 39 provided on a side of the base end (side of the rotational shaft 37) and capable of guiding the discharged sheet S to the discharged sheet stacking portion 40. The detection lever 36 also includes a recede portion 38*b* provided on the side of the base end and formed into a concave shape to depress in a direction opposite from a direction in which the plurality of guide portions 39 project. It is noted that this recede portion 38*b* composes a concave portion formed by the guide portions 39 and a surface 380 (see FIG. 5) of the detection lever 36 on which the guide portions 39 are formed and which faces the destaticizing brush.

More specifically, as shown in FIG. 6, each of the plurality of guide portions 39 is integrally formed with the detection lever 36 as a rib projecting toward upstream in the sheet discharge direction from the detection lever (turning portion) and is provided so as to be positioned substantially in parallel with the sheet discharge direction between the tilted hair-bundles 35 (places where they do not overlap with each other). That is, the plurality of guide portions 39 described above is provided downstream in the sheet discharge direction of the destaticizing brush 34 and at the widthwise different positions from the plurality of hair-bundles (destaticizing members) 34*a*. These guide portions 39 come into contact with and guide the sheet which is in contact with the plurality of the hair-bundles 34*a* to the discharged sheet stacking portion 40 and are configured such that the hair-bundles (destaticizing members) pushed by the sheet enter between the guide portions 39, respectively. Still further, a recede portion 38*b* is formed between the plurality of ribs at a position facing the destaticizing brush 34 as a portion receiving and storing the destaticizing brush 34 deformed by being pushed by the sheet. The recede portion 38*b* is provided adjacent the guide portion 39 and is formed into a concave shape such that the hair-bundle 34*a* located at an opposite position can recede when tilted by being pushed by the sheet S. The recede portion 38*b* is also configured such that a certain gap is generated between the tilted hair-bundle 34*a*. It is noted that not all of the hair-bundles 34*a* are stored in the concave portions 38*b* in the present embodiment, and a number of parts between the guide portions 39 is less than a number of hair-bundles 34*a* as the destaticizing members. However, the hair-bundles 34*a* described above are movable between the guide portions 39 including spaces between the detection levers 36 when the hair-bundles 34*a* come into contact with the sheet.

The rotational shaft 37 is turnably supported to the discharge upper guide 32 in a vicinity of the support portion 34*b* of the destaticizing brush 34. The plurality of detection levers 36 is linked to the rotational shaft 37 such that they are synchronized with each other. The plurality of detection levers 36 is configured such that the plurality of detection levers 36 turns centering on the rotational shaft 37 when the plurality of detection levers 36 is pushed by the sheet S.

Figure 7:
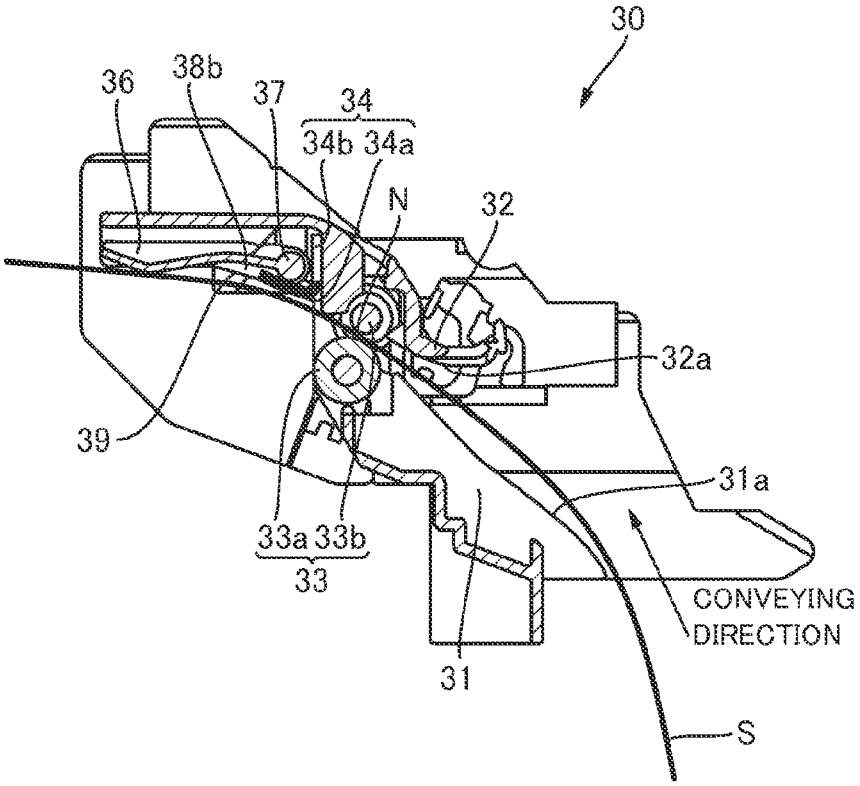
FIG. 7 is a section view showing a state in which the sheet discharge device discharges a sheet.

The sheet discharging operation performed by the sheet discharge device 30 constructed as described above will be explained with reference to FIG. 7. FIG. 7 is a section view showing the sheet discharge device 30 in a state in which the sheet discharge device 30 discharges the sheet S.

The sheet S on which the toner image has been fixed by the fixing portion 27 is conveyed to the sheet discharge device 30 by the roller pair in the fixing portion 27. The sheet S conveyed to the sheet discharge device 30 is guided by the lower guide surface 31*a* of the discharge lower guide and the upper guide surface 32*a* of the discharge upper guide 32 to the nip N of the discharge roller pair 33 and is discharged out of the apparatus by the discharge roller pair 33.

At this time, static electricity accumulated in the sheet S during its conveyance is removed (destaticized) as the sheet S being conveyed by the discharge roller pair 33 come into contact with the destaticizing brush 34 as it passes through the nip N. Specifically, the front end of the sheet S comes into contact with the plurality of hair-bundles 34*a* at first. When the sheet S is conveyed further, the plurality of hair-bundles 34*a* tilt by being pushed by the front end of the sheet S, and the removal of electricity is achieved as the tilted plurality of hair-bundles 34*a* come into contact with the upper surface of the moving sheet S. Because the plurality of hair-bundles 34*a* of the destaticizing brush 34 is disposed substantially at equal intervals in a range (region) longer than a widthwise length of the sheet S, the hair-bundles 34*a* come into contact with the sheet uniformly and the removal of electricity of the sheet S can be achieved reliably without dropping the destaticizing performance.

The sheet S that has tilted the plurality of hair-bundles 34*a* abut next against the plurality of guide portions 39 provided in each of the plurality of detection levers 36 and presses the plurality of detection levers 36 through the plurality of guide portions 39. The plurality of detection levers 36 pressed by the sheet S turns clockwise centering on the rotational shaft 37 as shown in FIG. 7 and guides the sheet S to the discharged sheet stacking portion 40. After that, during the sheet discharging operation performed by the discharge roller pair 33, the plurality of detection levers 36 is maintained at the turning position by stiffness (rigidity) of the sheet S.

At this time, the plurality of hair-bundles 34*a* is positioned (enter) the recede portions 38*b* of the detection lever 36 when the hair-bundle 34*a* tilts by being pushed by the front end of the sheet S. It is noted that because the sheet S is guided by the plurality of guide portions 39 projectively formed from the recede portion 38*b*, the sheet S will not enter the recede portion 38*b*. Therefore, the hair-bundles 34*a* are not sandwiched between the sheet S and the plurality of detection levers 36 even if the sheet S presses the plurality of guide portions 39 and when the plurality of detection levers 36 guides the sheet S. This makes it possible to reduce damages otherwise caused in the destaticizing brush 34 that destaticizes the sheet S. Still further, as shown in FIG. 5, because a surface 391 guiding the sheet of the guide portion 39 is a continuous surface continued to a surface coming into contact with the sheet of the abutment portion 38*a* of the detection lever 36, the sheet S is smoothly guided to the discharged sheet stacking portion 40.

When the sheet discharging operation performed by the discharge roller pair 33 ends after that, the plurality of detection levers 36 turns counterclockwise by their own weight and biases and presses the sheet S to the discharged sheet stacking portion 40 by their own weight. When the detection lever 36 reaches a predetermined rotational position after repeating these operations, the detection sensor 35*a* sends the predetermined detection signal. Then, the control portion 50 stops the image forming operation by receiving the predetermined detection signal. Then, if a job is left, the image forming operation is restarted if a user or the like removes the sheet bundle stacked on the discharged sheet stacking portion 40. The control portion ends the image forming process as it is if the job has been finished.

As described above, according to the printer 100 of the present embodiment, the hair-bundles 34*a* will not be sandwiched between the sheet S and the plurality of detection levers 36 even when the sheet is guided by the plurality of detection levers 36. Therefore, it is possible to prevent the hair-bundles 34*a* from being put into a state in which the hair-bundles 34*a* are rubbed and drawn and to prevent the tips of the hair-bundles 34*a* from being deformed in a curled manner. This arrangement makes it possible to prevent the destaticizing performance from being lowered due to a decrease of an area of contact with the sheet S caused by the curled hair-bundles. As a result, it becomes possible to adequately remove the static electricity charged to the sheet and to stably stack the sheet on the discharged sheet stacking portion 40.

Still further, it is possible to prevent the quality of the sheet S from dropping by contact marks and the like that can be generated when the curled hair-bundles 34*a* come in contact with the sheet S by preventing the deformation such as curling.

Still further, because the provision of the recede portion 38*b* permits the detection lever 36 to be disposed in the vicinity of the destaticizing brush 34, the sheet discharge device can be downsized. That is, the printer can be downsized. Still further, because it becomes possible to detect an upstream end in the sheet discharge direction of the sheet S stacked on the discharged sheet stacking portion 40 by disposing the detection lever 36 in the vicinity of the destaticizing brush 34, it is possible to improve accuracy of the full-load detection.

Still further, because it is not necessary to dispose the destaticizing brush while avoiding the detection levers, the hair-bundles can be disposed at equal intervals (uniformly) in the entire sheet widthwise region. Due to that, it is possible to prevent the destaticizing performance of the destaticizing brush 34 from dropping.

While the embodiment of the present invention has been explained above, the present invention is not limited to the embodiment described above. The advantageous effects described in the embodiment of the present invention are also mere enumeration of the most preferable effects brought about from the present invention, so that the effects of the present invention are not limited to those described in the embodiment of the invention.

Still further, while the detection lever 36 is constructed to be turnable centering on the rotational shaft 37 in the present embodiment, it is not always necessary to construct the detection lever to be turnable if a sheet guide function is to be simply given to the detection lever. In this case, the detection levers 36 may be constructed as a comb-like member composed of only the guide portions 39 and the recede portions 38*b* between the guide portions 39. Still further, the guide portion 39 may be configured to be turnable and to extend downward so that the lower part of the guide portion 39 is able to come in contact with the upper surface of the sheet on the discharged sheet stacking portion 40. This configuration makes it possible to detect a sheet stacking amount on the discharged sheet stacking portion 40 by the guide portion 39 being turned by in contact with the upper surface of the sheet on the discharged sheet stacking portion 40. Still further, it is not always necessary to integrate the guide portion 39 with the detection lever 36, and it is possible to configure such that the detection lever 36 is turned through the guide portion 39 separately constructed. While the present embodiment has been explained by exemplifying the electro-photographic printer, the present invention is not limited to that. For instance, the present invention is also applicable to an ink-jet type printer (image forming apparatus) forming an image on a sheet by discharging ink droplets from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-172141, filed on Aug. 22, 2013, which is hereby incorporated by reference herein in its entirety.

What is claimed is:

1. A sheet discharge device comprising:

a sheet discharge portion configured to discharge a sheet;

a plurality of destaticizing members arrayed in a width direction orthogonal to a sheet discharge direction and destaticizing the sheet discharged by the sheet discharge portion; and a guide member turning by being pushed by the sheet discharged by the sheet discharge portion and guiding the sheet to a stacking portion on which the discharged sheet is to be stacked, the guide member including:

a guide portion guiding the discharged sheet to the stacking portion, and a plurality of concave portions provided at a position facing the destaticizing members and accepting the destaticizing members deformed by being pushed by the sheet.

2. The sheet discharge device according to claim 1, wherein the guide member is configured to be able to come into contact with an upper surface of the sheet stacked on the stacking portion.

3. The sheet discharge device according to claim 2, further comprising a sensor sending a signal corresponding to a turning position of the guide member when the guide member is in contact with the sheet stacked on the stacking portion.

4. The sheet discharge device according to claim 1, wherein the destaticizing members are a plurality of hair-bundles.

5. The sheet discharge device according to claim 1, wherein the guide portion includes a plurality of ribs, and the concave portions are formed between the plurality of ribs.

6. The sheet discharge device according to claim 1, wherein the guide member is turnably supported centering on a shaft disposed downstream in the sheet discharge direction of the sheet discharge portion and above the sheet discharge portion.

7. An image forming apparatus comprising:

an image forming portion configured to form an image on a sheet: and the sheet discharge device according to claim 1 configured to discharge the sheet on which the image has been formed by the image forming portion.

8. A sheet discharge device comprising:

a sheet discharge portion configured to discharge a sheet to a stacking portion on which sheets are stacked;

a destaticizing portion destaticizing the sheet discharged by the sheet discharge portion; and a guide member provided downstream in a sheet discharge direction of the destaticizing portion and guiding the sheet destaticized by the destaticizing portion to the stacking portion, wherein the destaticizing portion is provided between the sheet discharge portion and the guide member in the sheet discharge direction and the guide member includes a receded portion accepting the destaticizing portion deformed by being pushed by the sheet being discharged by the sheet discharge portion.

9. The sheet discharge device according to claim 8, wherein the guide member is configured to be turnable by coming into contact with an upper surface of a sheet bundle discharged on the stacking portion to detect a sheet stacking amount of the stacking portion by a turning amount thereof.

10. The sheet discharge portion according to claim 9, wherein the destaticizing portion includes a plurality of destaticizing members and a plurality of the guide member are provided, the plurality of guide members are disposed at predetermined intervals in a width direction orthogonal to the sheet discharge direction, each guide member of the plurality of guide members includes ribs projecting upstream in the sheet discharge direction from a surface, on a side guiding the sheet, of a body of the guide member, and intervals between the ribs form receded portions each accepting one of the destaticizing members and a number of the intervals is less than a number of the destaticizing members.

11. The sheet discharge portion according to claim 10, wherein a surface guiding a sheet of each rib is a continuous surface continued to the surface, in contact with the sheet bundle, of the body of the guide member, and each interval between the ribs is a concave portion formed of the ribs and the surface of the body of the guide member.

12. The sheet discharge device according to claim 8, wherein the destaticizing portion is a destaticizing brush including a plurality of hair-bundles elastically deforming by abutting against the sheet, and the guide member includes guide portions provided at different positions from those of the plurality of the hair-bundles in the width direction and configured to be able to accept the hair-bundles deformed by abutting against the sheet between the guide portions.

13. The sheet discharge portion according to claim 8, wherein the destaticizing portion includes a plurality of destaticizing members and the guide member includes ribs projecting upstream in the sheet discharge direction from a surface, on a side of guiding the sheet, of a body of the guide member, and intervals between the ribs form receded portions each accepting one of the destaticizing members.

14. The sheet discharge portion according to claim 8, further comprising an apparatus main body to which the guide member is rotatably attached, wherein the destaticizing portion is fixed on the apparatus main body.

* * * * *